US008246493B1

(12) United States Patent
Ling

(10) Patent No.: US 8,246,493 B1
(45) Date of Patent: Aug. 21, 2012

(54) BATTING PRACTICE APPARATUS

(76) Inventor: Hung-Tai Ling, Taichung (TW)

( * ) Notice: Subject to any disclaimer, the term of this patent is extended or adjusted under 35 U.S.C. 154(b) by 0 days.

(21) Appl. No.: 13/094,918

(22) Filed: Apr. 27, 2011

(51) Int. Cl.
*A63B 69/00* (2006.01)
*A63B 71/16* (2006.01)

(52) U.S. Cl. ..... 473/417; 473/422; 473/451

(58) Field of Classification Search ..... 473/417–420, 473/422–429, 443, 444; D21/662; 482/85–87, 482/89, 90
See application file for complete search history.

(56) References Cited

U.S. PATENT DOCUMENTS 547,342 A * 10/1895 Foster ..... 482/87
732,096 A * 6/1903 Maxwell ..... 482/87
2,197,545 A * 4/1940 Bachman et al. ..... 473/444
2,913,245 A * 11/1959 Landis ..... 473/444
3,114,546 A * 12/1963 Verseghy ..... 482/87
3,226,116 A * 12/1965 Klingler ..... 482/87
4,953,852 A * 9/1990 Donohue ..... 482/87
4,993,708 A * 2/1991 Prossor et al. ..... 473/417
5,035,424 A * 7/1991 Liao ..... 473/423
5,386,988 A * 2/1995 Sung et al. ..... 473/423
5,415,396 A * 5/1995 Huang ..... 473/417
5,494,278 A * 2/1996 Linden ..... 473/427
5,797,810 A * 8/1998 Sandoval ..... 473/423
6,398,671 B1 * 6/2002 Rios ..... 473/417
6,551,204 B1 * 4/2003 Di Re ..... 473/417
6,719,649 B1 * 4/2004 Lin ..... 473/417
7,226,398 B2 * 6/2007 Fu ..... 482/85
2007/0049426 A1 * 3/2007 Huang ..... 473/417

* cited by examiner

*Primary Examiner* — Mitra Aryanpour
(74) *Attorney, Agent, or Firm* — Ming Chow; Sinorica, LLC

(57) ABSTRACT

A batting practice apparatus able to be installed on any flat surface includes a base, a batting unit, an air-pump unit and at least one suction unit. The batting unit is mounted on the topside of the base while the air-pump unit is installed in the interior of the base and connected with the batting unit, and the suction unit is also positioned in the base and communicates with the air-pump unit. When receiving external force to swing, the batting unit will actuate the air-pump unit to pump air out of the suction unit and form a vacuum chamber between the suction unit and the flat surface, able to increase the suction strength of the suction unit and lighten the batting practice apparatus.

6 Claims, 5 Drawing Sheets

BATTING PRACTICE APPARATUS

BACKGROUND OF THE INVENTION

1. Field of the Invention

This invention relates to a batting practice apparatus.

2. Description of the Prior Art

A conventional vertical batting practice apparatus, as shown in FIG. 1, includes a fixed base 1, an intermediate buffer device 2 mounted on the fixed base 1, and a batting sleeve body 3 secured on the intermediate buffer device 2. In the course of batting, when struck by external force, the batting sleeve body 3 will be able to bend properly and then elastically recover its original shape to enable a batter to continuously apply force to the batting sleeve body, thus achieving effects of physical exercises and batting practice. However, during batting practice, the batting practice apparatus will be struck by strong external force and cause displacement. In order to stably fix the batting practice apparatus, the method is either to have the fixed base 1 of the batting practice apparatus completely made of metal, which may cause high cost and heavy weight, or to have the interior of the fixed base 1 filled with balance weight metal or stuff, or to have the fixed base 1 directly and immovably locked on the ground. In this case, after being provided and positioned, the batting practice apparatus is impossible to be moved at will and hence a user usually has to practice batting at a fixed location, restricted in practice location, deficient in mobility and inconvenient in use.

SUMMARY OF THE INVENTION

The objective of this invention is to offer a batting practice apparatus, which includes a base, a batting unit, an air-pump unit and at least one suction unit. The base is formed with a fixed portion, a tubular portion formed to extend from an upper side of the fixed portion, and a recessed accommodating groove formed under the upper side of the fixed portion. The tubular portion has its free end bored with an internal hole communicating with the accommodating groove and having its circumferential side defined by a circumferential wall, which is bored with an exhaust aperture. The batting unit is mounted on the free end of the tubular portion, having one end positioned in the internal hole of the tubular portion. The air-pump unit is installed in the interior of the internal hole of the tubular portion and connected with one end of the batting unit for carrying out interaction. The suction unit is set in the accommodating groove of the base, connected and communicated with another end of the air-pump unit.

The batting practice apparatus in the present invention can be installed on any flat surface for use. When receiving external force, the batting unit will be driven to swing bias and actuate the air-pump unit to pump air out of the suction unit and then exhaust the air out of the base through the exhaust aperture to form a vacuum chamber between the suction unit and the flat surface for increasing the suction strength of the suction unit, needless to add necessary weight to the batting practice apparatus and able to elevate mobility of the batting practice apparatus.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
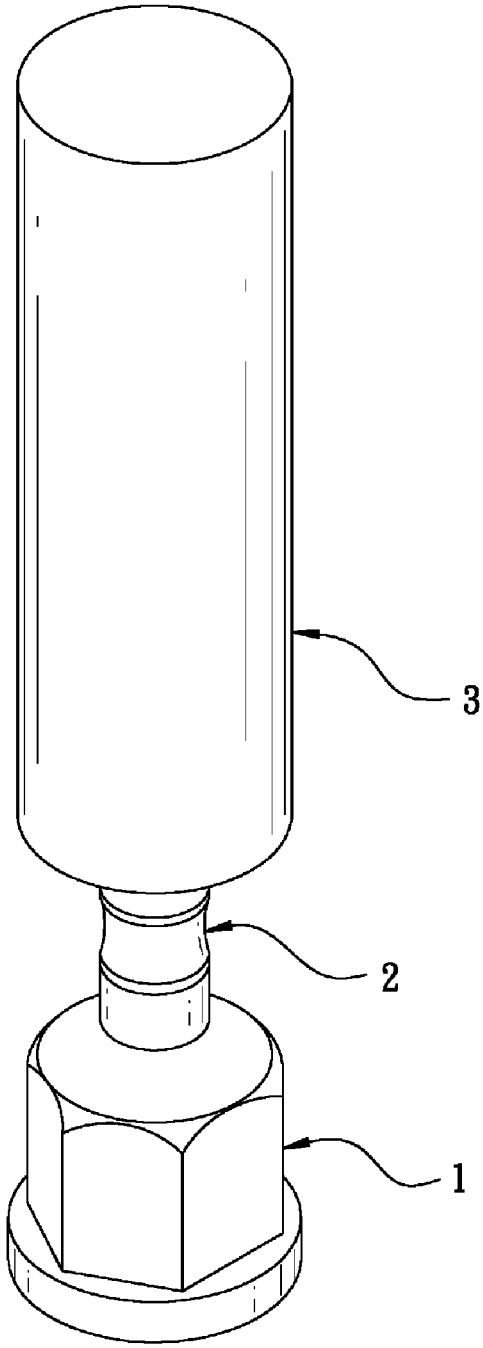
FIG. 1 PRIOR ART
FIG. 1 is a perspective view of a conventional vertical batting practice apparatus.
Figure 2:
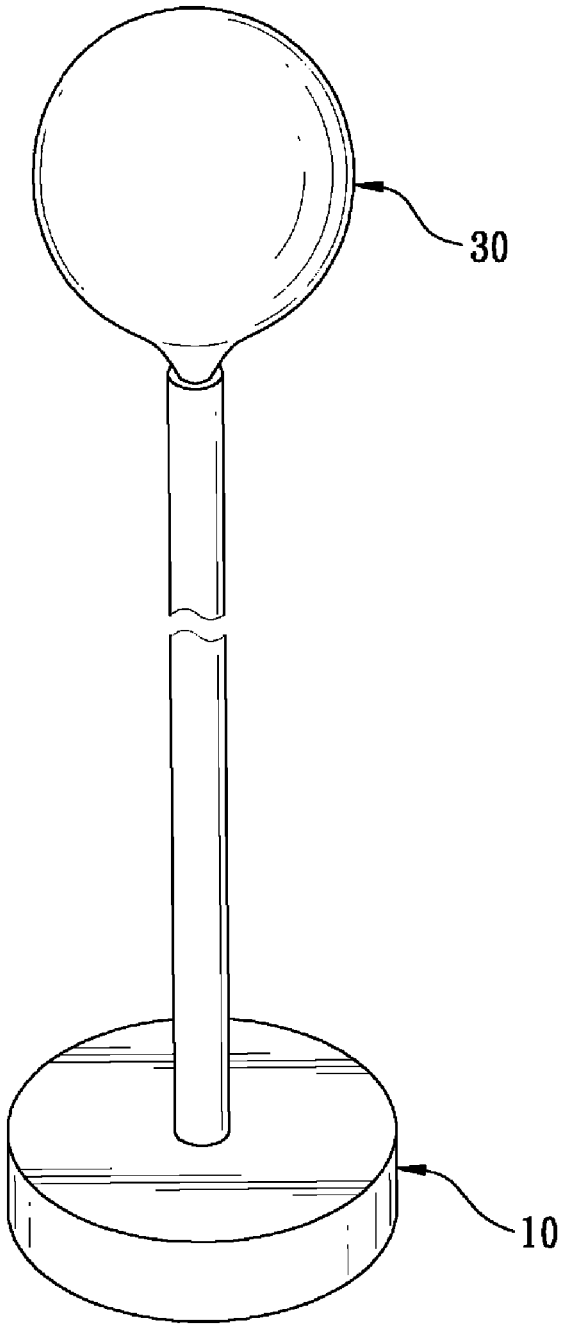
FIG. 2 is a perspective view of a first preferred embodiment of a batting practice apparatus in the present invention.
Figure 3:
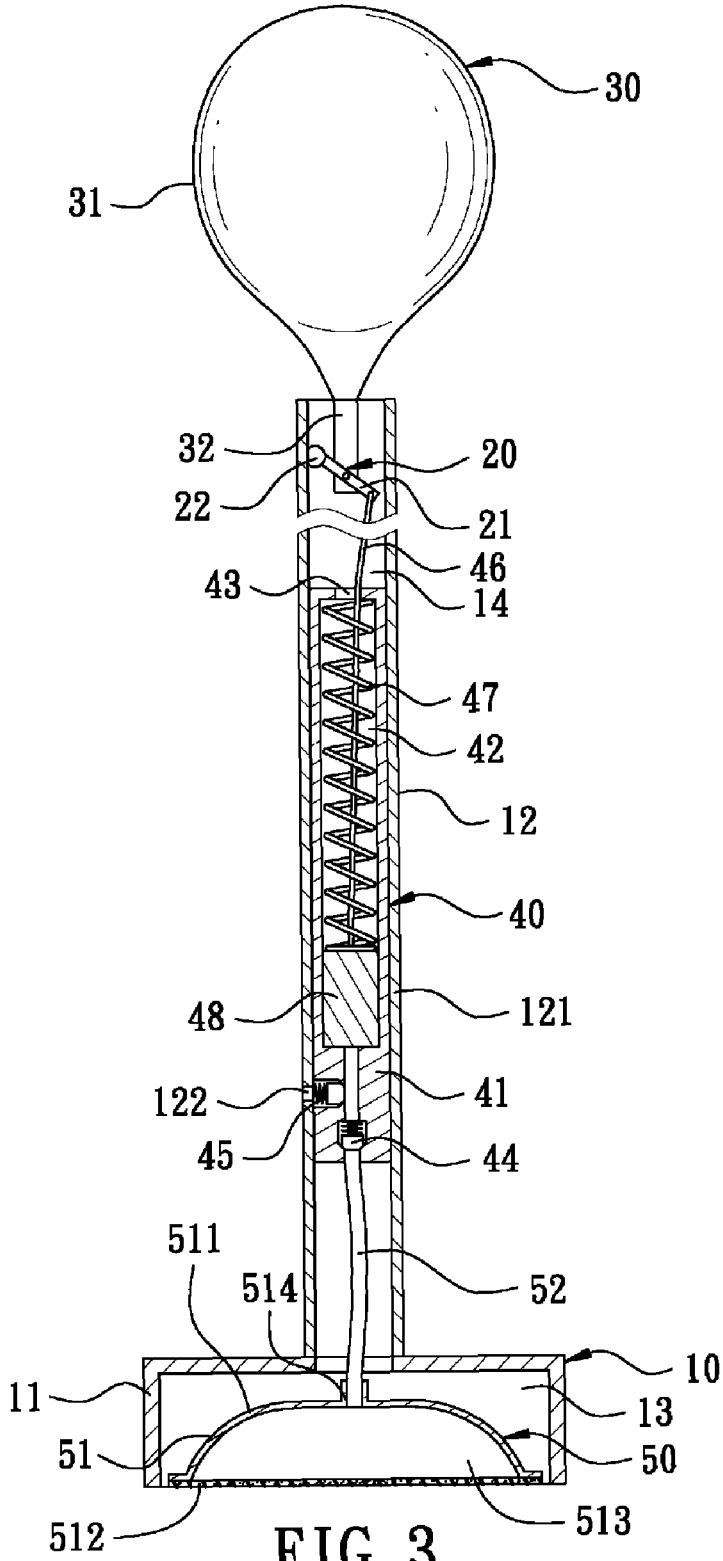
FIG. 3 is a cross-sectional view of the first preferred embodiment of the batting practice apparatus in the present invention.

A first preferred embodiment of a batting practice apparatus in the present invention, as shown in FIGS. 2 and 3, includes a base 10, an interconnecting unit 20, a batting unit 30, an air-pump unit 40 and at least one suction unit 50 as main components combined together.

The base 10 is formed with a fixed portion 11, a tubular portion 12 formed to extend upward from an upper side of the fixed potion, and an accommodating groove 13 formed under the upper side of the fixed portion. The tubular portion 12 has a free end provided with an internal hole 14 bored downward axially to communicate with the accommodating groove 13 and defined by a circumferential wall 121 of the tubular portion. An exhaust aperture 122 is bored in the circumferential wall 121 to communicate with the outside.

The interconnecting unit 20 is pivotally assembled on the interior side of the circumferential wall 121 of the tubular portion 12, consisting of a pivotal rod 21 and a universal joint 22. The pivotal rod 21 is rotatably combined with the circumferential wall 121 via the universal joint 22.

The batting unit 30 is fixed on the topside of the base 10 and used for batting. The batting unit 30 is formed with a batting target portion 31 made of elastic material and shaped as an oval ball. The batting target portion 31 has a lower side extended downward to bond with an elastic post 32 whose free end is positioned in the internal hole 14 and pivotally connected with the pivotal rod 21 at a location adjacent to the universal joint 22. When receiving external force, the batting target portion 31 will be actuated to bend upward and swing elastically.

The air-pump unit 40 is installed in the internal hole 14, and formed with a seat 41 having an interior hollow chamber 42. The seat 41 has its upper portion bored with a through hole 43 communicating with the hollow chamber 42, its lower portion provided with an air-pump valve 44 communicating with the hollow chamber 42 and its circumferential wall provided with an exhaust valve 45 corresponding to the exhaust aperture 122. The hollow chamber 42 is assembled therein with a pull member 46, an elastic member 47 and a piston 48 having its outer surface closely contacting with the wall of the hollow chamber 42. The pull member 46 is inserted through the through hole 43 and has two ends respectively connected with the free end of the pivotal rod 21 and the piston 48 so that the piston 48 can be actuated to interact with the batting unit 30 by means of the pivotal rod 21 and shift up and down axially in the hollow chamber 42, while the elastic member 47 is positioned between the through hole 43 and the piston 48. In this preferred embodiment, the air-pump valve 44 and the exhaust valve 45 are non-return valves while the pull member 46 is a pull rope, and the elastic member 47 is a spring.

The suction unit 50 is disposed in the accommodating groove 13 of the base 10, connected and communicated with the air-pump unit 40, and composed of a suction cup 51 and a connecting pipe 52. The suction cup 51 contains a cup body 511 and a valve 512 firmly connected together, having an air chamber 513 formed between the cup body 511 and the valve 512. The cup body 511 has a topside bored with a through hole 514 communicating with the air chamber 513, while the connecting pipe 52 has two ends respectively communicating with the air-pump valve 44 and the through hole 514.

Figure 4:
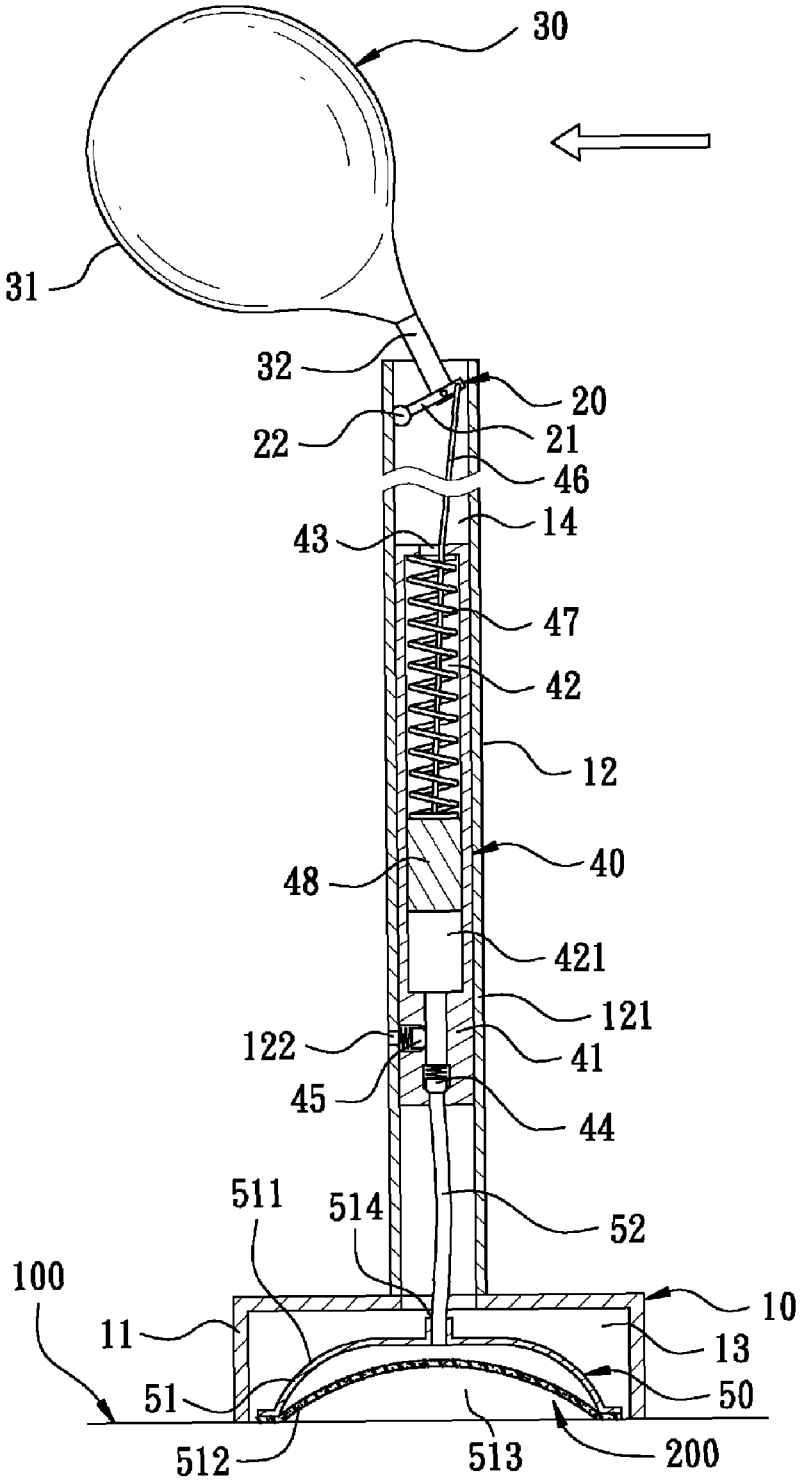
FIG. 4 is a cross-sectional view of the first preferred embodiment of the batting practice apparatus in a using condition in the present invention.

In use, referring to FIG. 4, firstly, have the batting practice apparatus of this preferred embodiment vertically positioned on a flat surface 100 to let the suction unit 50 fixed on the flat surface 100 and then, apply force to the batting unit 30 to let the batting target portion 31 receive the force and swing bias upward, leftward and rightward relative to the base 10 via the elastic post 32. When the batting target portion 31 swings bias leftward and rightward, the pivotal rod 21 will be actuated to turn upward pivotally, and meanwhile the piston 48 will be driven to move upward to push and press the elastic member 47 to contract by interaction of the pull member 46 and the pivotal rod 21. At this time, a closed space 421 will be formed in the interior of the hollow chamber 42. The produced vacuum suction will force the air in the air chamber 513 guided into the interior of the air-pump valve 44 through the connecting pipe 52 and finally the air will get into the closed space 421. Simultaneously, the elastic member 47 with elastic restoring force will produce a reaction force to the piston 48 to force the piston 48 to move downward and recover its original position. The closed space 421 will become smaller and smaller in the wake of the displacement of the piston 48 and the air pressure in the closed space 421 will become greater and greater to force the air in the closed space 421 to be guided into the exhaust valve 45 and then exhausted out of the base 10 through the exhaust aperture 122. Thus, by repeating the action of moving up and down of the piston 48, air in the air chamber 513 can be gradually exhausted out of the base 10. At this time, the air chamber 513 will produce a vacuum suction in the interior to suck and move the valve 512 upward and gradually form a vacuum chamber 200 between the valve 512 and the flat surface 100, able to produce powerful and strong suction to the flat surface 100. Therefore, the suction unit 50 can be sucked and fixed on the flat surface 100 more closely so as to enhance the sucking and fixing strength between the batting practice apparatus and the flat surface 100, needless to install necessary balance weight in the batting practice apparatus. By so designing, the batting practice apparatus of this invention has light weight and high mobility.

Figure 5:
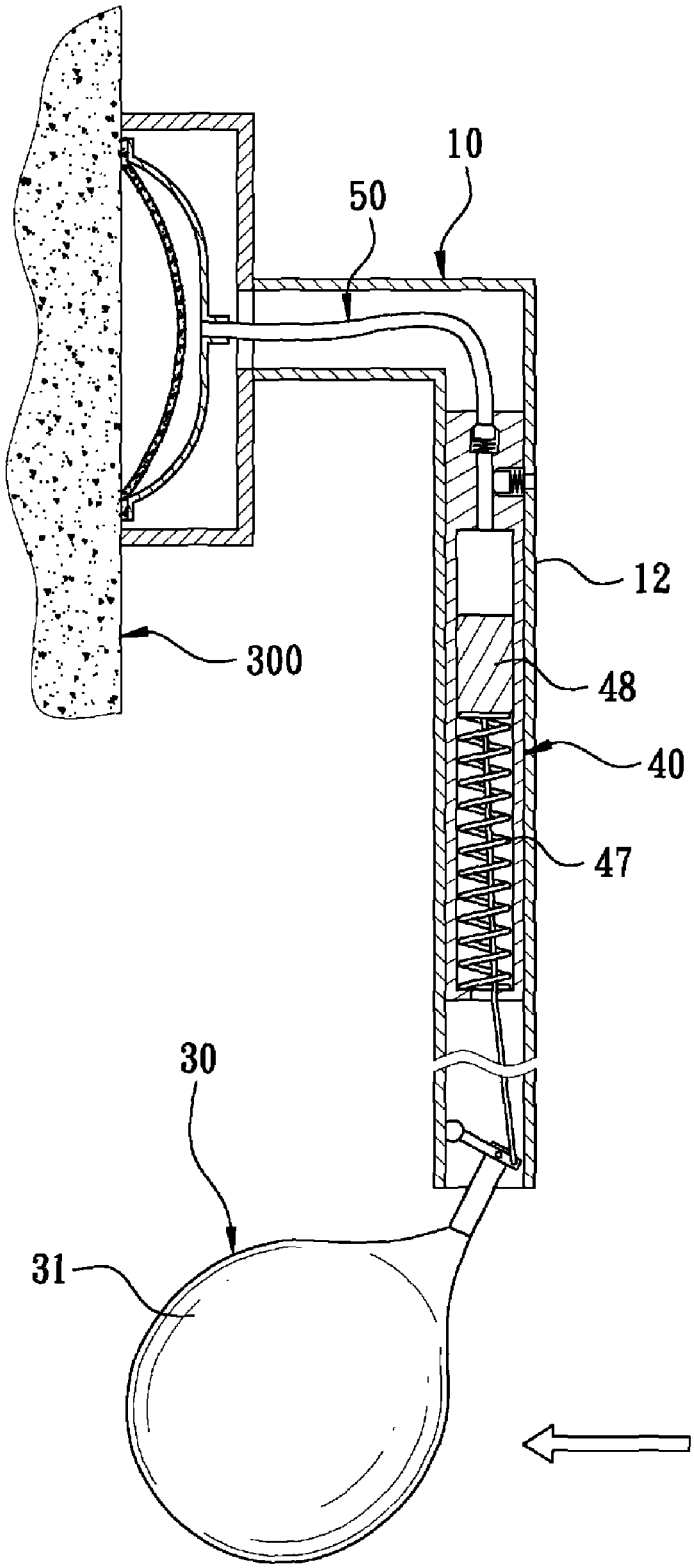
FIG. 5 is a cross-sectional view of a second preferred embodiment of a batting practice apparatus in a using condition in the present invention.

A second preferred embodiment of a batting practice apparatus in the present invention, as shown in FIG. 5, has almost the same structure as that described in the first preferred embodiment, except that the batting practice apparatus of the second preferred embodiment is installed on a wall surface 300, and the tubular portion 12 is bent into an L shape and the free end of the tubular portion 12 is extended downward. When receiving external force, the batting target portion 31 of the batting unit 30 will be actuated to swing bias leftward and rightward and simultaneously, the piston 48 will be driven to push and press the elastic member 47 and then actuated to recover its original position via the elastic restoring force of the elastic member 47. By repeating the action of moving up and down of the piston 48, the air in the interior of the suction unit 50 can be exhausted out of the base 10 by the air-pump unit 40, thus enabling the suction unit 50 to be closely sucked and fixed on the wall surface 300.

While the preferred embodiments of the invention have been described above, it will be recognized and understood that various modifications may be made therein and the appended claims are intended to cover all such modifications that may fall within the spirit and scope of the invention.

What is claimed is:

1. A batting practice apparatus comprising:

a base formed with a fixed portion, a tubular portion formed to extend upward from an upper side of said fixed portion, and an accommodating groove formed under said upper side of said fixed portion;

said tubular portion having a free end bored with an internal hole communicating with said accommodating groove;

said internal hole of said tubular portion being defined by a circumferential wall bored with exhaust aperture;

a batting unit mounted on said free end of said tubular portion and having one end positioned in said internal hole of said tubular portion;

an air-pump unit installed in said internal hole of said tubular portion, connected with the one end of said batting unit for carrying out interaction, and formed with a seat having an interior hollow chamber;

said seat having an upper portion bored with a through hole communicating with said hollow chamber and a lower portion provided with an air-pump valve communicating with said hollow chamber, and further set with an exhaust valve corresponding to said exhaust aperture; and at least one suction unit assembled in said accommodating groove of said fixed portion and communicating with another end of said air-pump unit, wherein in case of receiving external force, said batting unit interacts with said air pump unit to pump air out of said suction unit from said exhaust aperture in said circumferential wall of said tubular portion so that said base can be firmly sucked and fixed on a flat surface by said suction unit.

2. A batting practice apparatus as claimed in claim 1, wherein an interconnecting unit is pivotally assembled on an interior side of said circumferential wall of said tubular portion;

said interconnecting unit is composed of a pivotal rod and a universal joint; and said pivotal rod is rotatably combined with said circumferential wall via said universal joint.

3. A batting practice apparatus as claimed in claim 2, wherein said batting unit is formed with a batting target portion and an elastic post formed in a lower side of said batting target portion; and said elastic post has a free end positioned in said internal hole and pivotally connected with said pivotal rod.

4. A batting practice apparatus as claimed in claim 3, wherein said hollow chamber is installed therein with a pull member, an elastic member and a piston;

said pull member has two ends respectively connected with said pivotal rod and said piston so that said piston can be actuated to interact with said batting unit via said pivotal rod and shift axially in said hollow chamber; and said elastic member is positioned between said through hole of said seat and said piston.

5. A batting practice apparatus as claimed in claim 4, wherein said suction unit is composed of a suction cup and a connecting pipe; said suction cup contains a valve and a cup body bored with a through hole; and said connecting pipe has two ends respectively communicating with said air-pump valve and said through hole of said cup body.

6. A batting practice apparatus as claimed in claim 1, wherein said tubular portion is bent into an L shape.

* * * * *